United States Patent [19]

Leino et al.

[11] 4,197,657

[45] Apr. 15, 1980

[54] PROCEDURE FOR DRYING AN ORGANIC, MOST APPROPRIATELY AXYLOGENIC MATERIAL, SUCH AS VENEERS FOR INSTANCE

[76] Inventors: Ilkka M. Leino, Pajalahdentie 17 D, 00210 Helsinki 21; Martti H. Leino, Lauttasaarentie 7, 00200 Helsinki 20, both of Finland

[21] Appl. No.: 879,257

[22] Filed: Feb. 21, 1978

[51] Int. Cl.[2] ..... F26B 5/04

[52] U.S. Cl. ..... 34/15; 34/16.5; 34/51; 34/92

[58] Field of Search ..... 34/13.8, 15, 51, 92, 34/16.5

[56] References Cited

U.S. PATENT DOCUMENTS

| | | | |
|---|---|---|---|
| 685,287 | 10/1901 | Mende | 34/51 |
| 3,077,036 | 2/1963 | Neumann | 34/92 |
| 3,298,108 | 1/1967 | Seffinga | 34/15 X |
| 4,058,906 | 11/1977 | Pagnozzi | 34/92 |

*Primary Examiner*—John J. Camby

*Attorney, Agent, or Firm*—J. Harold Nissen

[57] ABSTRACT

Procedure for drying an organic material, most suitably one which is xylogenic (originating from wood), such as veneers for instance, by means of hot circulating air which circulates in the drying space from a blower to a heat exchanger, passes by the organic material, collecting the water vapor released by the material, and further to the blower, whereafter part of the air/water vapor mixture is conducted through a vent, throttled by means of a damper, into the free atmosphere. In the drying space, the temperature and pressure are monitored, and the damper is used to control the vented air quantity in such manner that there is continuously a given, predetermined vacuum in the drying space.

9 Claims, 1 Drawing Figure

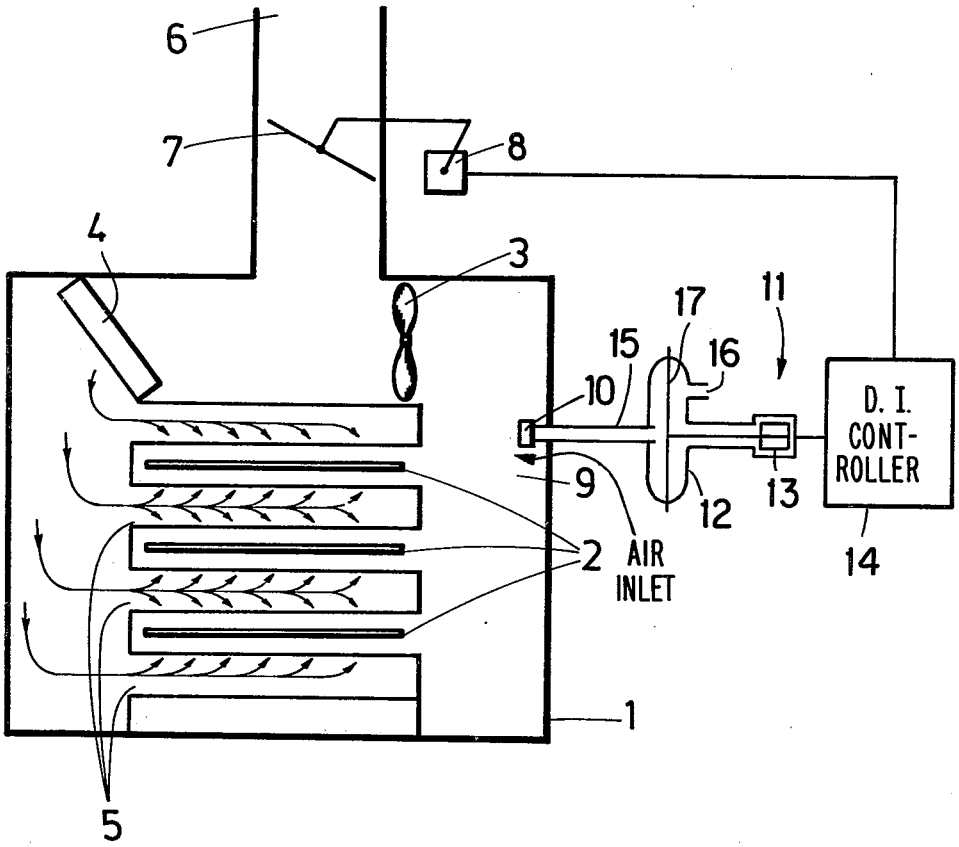
6
7
8
4
3
17
11
15
16
10
D. I.
CONT-
ROLLER
9
12
13
2
AIR
INLET
14
1
5

PROCEDURE FOR DRYING AN ORGANIC, MOST APPROPRIATELY AXYLOGENIC MATERIAL, SUCH AS VENEERS FOR INSTANCE

BACKGROUND OF THE INVENTION

At present, energy is unnecessarily wasted in veneer drying, owing to the fact that the conditions of the drying process vary considerably (veneer quality, degree of filling of the drying machine, etc.) But, the adjustable circulating air vent damper is kept in a position such that the drying machine will not release into the plant hall the gases produced in the drying process. The result hereof is a situation wherein the vent damper is in a theoretical optimum position, as regards heat economy, during short moments only, while the damper is opened unnecessarily wide the greater part of the time, thus letting thermal energy escape from the drying process.

As a result of the foregoing, the water content of the circulating air is at present in a range from 80 to 110 kg $H_2O$ per kg of dry air. In such case between 30 and 40% of the total energy are used to heat replacement air.

If the vent damper is so controlled that it is constantly in its otimum position (whereby the requirements of replacement air are minimized), it is possible to reduce the amount of heat energy that has to be consumed to heat the replacement air, and theoretically it is possible to reduce above-mentioned 30 to 40% of the total energy used. Since the thermal energy consumption of the drying machine is, depending on its capacity, 15 to $28\times10^3$ Gcal per year, a conservative calculation shows that the annual savings can be 15%, or between 2250 and 4200 Gcal per year. (6000 hrs$\times$2.5 $m^3$/hr to 6000 hrs$\times$5 $m^3$/hr)$\times$0.95 Gcal per $m^3$ of dry veneer.

With the aid of the present invention, the above-mentioned advantages are gained. The procedure of the invention is characterized in that the pressure in the drying space is monitored and the damper is operated to control the vented air quantity in such manner that there will continuously be a certain predetermined vacuum in the drying space.

When the water content of the circulating air is high, thermal energy is transferred from the circulating air to the veneer with considerably greater efficiency than from dry circulating air. The veneer that is being dried will then heat up rapidly, and the evaporation of the water present in the veneer starts quite clearly sooner than in a dry atmosphere, and the drying of the veneer is speeded up.

An advantageous embodiment of the invention is characterized in that with the aid of the pressure in the drying space the humidity of the circulating air is determined, and the damper is controlled so as to maintain the humidity of the circulating air within 250 to 400 g $H_2O$ per kg. Keeping the humidity of the circulating air within these limits, one obtains the best results in veneer drying.

The invention is described in the following with the aid of an example, with reference made to the attached drawing, which shows in cross section a drying machine the operation of which is based on the procedure of the invention.

The drying machine 1 comprises a circulating air blower 3, a heating element 4, nozzle boxes 5, and a vacuum space 9, wherein the circulating air circulates. The machine also comprises a vent pipe 6 removing the drying gases, containing the gas venting regulating damper 7. The position of the damper 7 is controlled by means of the action means 8, which receives a pulse from the control unit 11, this unit being connected to a sensor 10 in the vacuum space 9. The material 2 to be dried, in this instance consisting of veneer sheets, is disposed between the nozzle boxes 5.

Control unit 11 is conventional and includes a conventional diaphragm 12, a conventional differential transformer 13 and a conventional P1 controller 14. Diaphragm 12 includes a first conduit 15 connected with sensor 10 and a second conduit 16 open to the free space. Diaphragm 12 senses the pressure difference between the vacuum in space 9 fed through conduit 15 and an equivalent point outside the machine 1 applied through conduit 16. The differential transformer 13 is responsive to the position of diaphragm 17 and produces an output signal which is characteristic of the position of the diaphragm 17. The output signal is then fed to the conventional PI controller 14 which is provided with relays to control the damper motor 8. The damper motor 8 is a reversible rotatable motor so that it rotates in a first direction to close the damper 7 and rotates in a second direction to open the damper 7. The motor 8 is provided with two motor windings; one of the relays in controller 14 activates one of the motor windings for rotation of the motor in the other direction.

The blower 3 draws circulating air from the space 9 and feeds it through the heater 4 into the nozzle boxes 5. At the same time, part of the circulating air is vented through the vent pipe 6. The quantity thus removed may be controlled by means of the damper 7. Adjustment of this damper has a direct effect on the vacuum prevailing in the space 9.

The vacuum in the space 9 is monitored by means of the sensor 10, and the pressure reading obtained is used to control the position of the gas venting damper 7. The vacuum in the space 9 is kept at that particular limit at which the gases will not yet escape into the hall in which the drying machine is operating.

In the drying machine 1, a pressure pickup 10 is employed to monitor the pressure (the vacuum within the machine) at the point indicated by the air inlet marked on the drawing where the replacement air flows in from the plant hall into the machine. This point lies in the immediate vicinity of the through-passages of the material 2. When the said pressure is measured and it is compared with the atmospheric pressure at an equivalent point outside the machine 1, in the plant hall, the differential pressure between the exterior and interior of the machine is found, which correlates directly with the replacement air rate. When this differential pressure is regulated, by throttling the air vent passage 6, to be such that the replacement air flow rate is at a level at which the replacement air effects only partial dilution of the circulating air, the humidity of the circulating air can be accurately controlled with the aid of the above-mentioned differential pressure.

By the aid of the procedure of the invention the replacement air quantity is minimized by keeping the venting damper in that particular position which results in that the differential pressure on the outside and inside of the replacement air inlet aperture is kept low. The quantity of the replacement air flowing into the machine correlates directly with the said differential pressure. As water evaporates in the drying space, the partial pressure of water vapour and the gas pressure both increase. The pressure sensor will then detect the rise of pressure and this sensor operates the controller 11, which opens or closes the vent damper 7 so that the differential pressure at the replacement air inlet aperture remains constant and the quantity of inflowing replacement air remains such as is desired, and low.

It is obvious to one skilled in the art that various embodiments of the invention may vary within the scope of the claims following below.

We claim:

1. In a method for drying veneers formed from xylogenic material, which comprises drying the veneers in a drying machine having a plurality of heat exchangers in the form of nozzle boxes for supporting the veneers therebetween, a vent pipe with a damper therein for the regulation of the vent opening, a circulatory air blower and a heating element, and control means connected with the damper and the interior of the drying machine comprising the steps of circulating hot air in a drying space from the blower to the heat exchanger, passing the hot air passed the veneers for releasing water vapor therefrom, to form a mixture of water vapor and air, blowing the mixture of water vapor and air by means of said blower passed said vent pipe and through said heater, conducting a part of the mixture of water vapor and air through said vent pipe for venting therethrough into the free atmosphere, in which the improvement comprises:

continuously monitoring the pressure in the drying space in the drying machine to control the movement of the damper to control the quantity of the mixture of air and water vapor which is vented through the vent pipe to provide a predetermined vacuum in the drying space.

2. In a method as claimed in claim 1, including sensing the pressure in the drying machine at the point where replacement air flows in from the plant hall, and sensing the pressure at an equivalent point external of the drying machine to obtain a differential pressure between the pressure exterior of and interior of the drying machine, said differential pressure being regulated by said damper for throttling the vent pipe such that the replacement air flow rate is at a level at which the replacement air effects only partial dilution of the circulating air whereby the humidity of the circulating air is accurately controlled in relation to said differential pressure.

3. In the method as claimed in claim 1, wherein the humidity of the circulating air is kept within 250 to 400 g $H_2O$ per kg.

4. In the method as claimed in claim 2, wherein the position of the damper is responsive to the differential pressure to control the humidity in the circulating air.

5. A drying machine for drying veneers formed from a xylogenic material comprising in combination:

enclosure means having a vent pipe for removing drying gases and a vacuum space and including an air inlet;

a plurality of nozzle boxes in said vacuum space, said nozzle boxes being spaced from each other for receiving therebetween the veneers to be dried;

a heating element in said vacuum space;

a circulating air blower in said vacuum space, a sensor in said vacuum space to monitor the pressure and the vacuum in said enclosure means at the point where replacement air flows in from the plant hall;

a movable damper in said vent pipe to control the quantity of drying gases removed; and control means connected with said damper and said sensor, said control means including:

a control unit external of said enclosure means responsive to said sensor and to pressure external of said enclosure means and action means connected with said damper and said control unit and responsive to a pulse therefrom to vary the position of said damper in said vent pipe to control the quantity of drying gases passing through said vent pipe.

6. The drying machine as claimed in claim 5, wherein said control means maintains the humidity in the circulating air between 250 to 400 g $H_2O$ per kg.

7. The drying machine as claimed in claim 5, wherein said point at which the replacement air flows in lies in the immediate vicinity of through-passages of the veneers to be dried.

8. The drying machine as claimed in claim 5, wherein said vent is positioned between said heating element and said circulating air blower in the path of air circulation between said heater and said blower upstream thereof.

9. The drying machine as claimed in claim 5 or 6, wherein said blower draws circulating air from said vacuum space past said vent pipe and feeds said circulating air through said heating element into said nozzle boxes, and part of the circulating air is vented through said vent pipe as it moves therepast, and said damper being responsive to and movable in said vent pipe to control the opening thereof so that the vacuum in said vacuum space is kept at the particular limit at which the gases will not escape into a hall in which the drying machine is operating.

* * * * *